US007584636B2

(12) United States Patent
Arai

(10) Patent No.: US 7,584,636 B2
(45) Date of Patent: Sep. 8, 2009

(54) METAL SPINNING METHOD AND APPARATUS

(75) Inventor: Hirohiko Arai, Ibaraki (JP)

(73) Assignee: National Institute of Advanced Industrial Science and Technology, Tokyo (JP)

( * ) Notice: Subject to any disclaimer, the term of this patent is extended or adjusted under 35 U.S.C. 154(b) by 90 days.

(21) Appl. No.: 10/581,618

(22) PCT Filed: Dec. 1, 2004

(86) PCT No.: PCT/JP2004/017869

§ 371 (c)(1),
(2), (4) Date: Mar. 14, 2007

(87) PCT Pub. No.: WO2005/056210

PCT Pub. Date: Jun. 23, 2005

(65) Prior Publication Data

US 2008/0022741 A1 Jan. 31, 2008

(30) Foreign Application Priority Data

Dec. 8, 2003 (JP) ..... 2003-409563

(51) Int. Cl.
*B21B 37/58* (2006.01)

(52) U.S. Cl. ..... 72/10.4; 72/14.4; 72/80; 72/82

(58) Field of Classification Search ..... 72/10.4, 72/10.6, 14.4, 14.5, 21.4, 215, 81, 82, 83, 72/84, 85, 121, 80, 125, 370.26
See application file for complete search history.

(56) References Cited

U.S. PATENT DOCUMENTS

| | | | | |
|---|---|---|---|---|
| 4,509,351 | A * | 4/1985 | Rolin et al. | 72/10.4 |
| 5,220,817 | A * | 6/1993 | Wenzel et al. | 72/84 |
| 5,775,151 | A * | 7/1998 | Massee | 72/10.4 |
| 5,901,595 | A * | 5/1999 | Massee | 72/81 |
| 6,637,248 | B2 * | 10/2003 | Ishii et al. | 72/121 |
| 7,134,304 | B2 * | 11/2006 | Nakayama et al. | 72/102 |

(Continued)

FOREIGN PATENT DOCUMENTS

| | | |
|---|---|---|
| JP | 59-61529 | 4/1984 |

(Continued)

*Primary Examiner*—Edward Tolan
(74) *Attorney, Agent, or Firm*—Morgan, Lewis & Bockius LLP

(57) ABSTRACT

A method and an apparatus for a metal spinning operation capable of spinning a product having a non-circular cross section normal to an axis of rotation such as a polygonal/elliptic one. The actuators of a forming roller (5) are driven with feedback signals from a force sensor (8) fitted to the forming roller (5) to control the pushing force of the forming roller (5) so as to form a work (1) following the cross section shape of a mandrel (3), so that the product having the non-circular cross section normal to the axis of rotation can also be formed. The motion of the forming roller (5) in the forming operation is stored, the shape of the mandrel (3) near the point of the forming roller (5) contacting with the work (1) is estimated based on the motion of the forming roller (5) from a time point before one rotation of the mandrel (3), and according to the estimation, the rotational speed of a motor for rotating the mandrel (3) is controlled for the forming operation.

6 Claims, 7 Drawing Sheets

U.S. PATENT DOCUMENTS 7,152,445 B2 * 12/2006 Massee ..... 72/84

FOREIGN PATENT DOCUMENTS

| | | |
|---|---|---|
| JP | 4-22648 B | 4/1992 |
| JP | 5-508585 | 12/1993 |
| JP | 2003-48024 | 2/2003 |
| JP | 2003-181555 | 7/2003 |
| JP | 2004-223558 | 8/2004 |

* cited by examiner

METAL SPINNING METHOD AND APPARATUS

TECHNICAL FIELD

The present invention relates to a metal spinning method and an apparatus for practicing the method.

RELATED ART

The metal spinning is a method for centering a work of a metal sheet in a mandrel and rotating the work together with the mandrel and for forming the work while pushing it using a forming roller. The metal spinning method has been widely used in the conventional art for manufacturing the various parts or products.

Since the metal spinning operation forms the work while rotating the mandrel and the work, the forming roller position in the radial direction of the mandrel is generally held at a predetermined position with respect to the feed of the forming roller in the direction of the axis of rotation of the mandrel. In the conventional art, therefore, the metal spinning method has been applied only for forming a product having a circular cross section normal to the mandrel axis.

There has been invented (as referred to Patent Document 1) a method for forming a product having a non-circular cross section such that the forming roller is caused to follow the mandrel by pushing it onto the work with a constant force of a hydraulic cylinder.

As another method (as referred to Patent Document 2), there has also been invented a method for forming a product having a non-circular cross section such that the shape data of the product is stored in advance before processed, so that the forming roller is moved back and forth on the basis of the stored shape data.

Patent Document 1: Japanese Patent No. 1,732,924

Patent Document 2: JP-A-2001-379875

Problems to be Solved by the Invention

In the method of Patent Document 1, however, the rotational speed of the mandrel and the work has to be so suppressed lower than the ordinary one that the response of the extract/contract of the hydraulic cylinder may follow the change in the radial length of the mandrel. This necessity raises a problem that the forming speed is extremely lowered.

In the method of Patent Document 2, on the other hand, the mandrel has to be measured before the forming operation. Another problem is that the three-dimensional data of the measurement results needs a massive storage capacity.

The present invention has an object to solve the aforementioned problems in the metal spinning of the conventional art, and to realize a method and an apparatus for metal spinning of a product having a non-circular cross section normal to an axis of rotation such as a polygonal or elliptic one, without lowering the forming rate extremely or using the three-dimensional shape data of the product.

Means for Solving the Problem

In order to solve the aforementioned problems, according to the invention, there is provided a metal spinning method for forming a work of a metal sheet by pushing the work onto a rotating mandrel using a forming roller, the metal spinning method including the steps of: driving actuators of the forming roller with feedback signals from a force sensor fitted to the forming roller, to control the pushing force of the forming roller; and forming the work following the cross section shape of the mandrel, so that the product having the non-circular cross section normal to the axis of rotation can be formed.

There is provided the metal spinning method, wherein the motion of the forming roller in the forming operation is stored; the shape of the mandrel near the point of the forming roller contacting with the work is estimated based on the motion of the forming roller from a time point before one rotation of the mandrel; and according to the estimation, the rotational speed of a motor for rotating the mandrel is controlled for the forming operation.

There is provided the metal spinning method, wherein a jig shaped to merge into the front surface of the mandrel is used to clamp the work fixedly between the mandrel and the jig; and the forming roller is fed at first in the direction of the axis of rotation of the mandrel while being pushed onto the jig, so that the forming operation of the work is smoothly started.

In order to solve the aforementioned problems, according to the invention, there is provided a metal spinning apparatus including: a forming roller having a force sensor fixed thereto, and actuators for driving the forming roller, wherein the actuators drive the forming roller to spin a work of a metal sheet by pushing the work onto a rotating mandrel; the actuators control the pushing force of the forming roller with feedback signals from the force sensor; and the forming roller forms the work following the cross section shape of the mandrel, so that the product having the non-circular cross section normal to the axis of rotation of the mandrel can also be formed.

There is provided the metal spinning apparatus, wherein the motion of the forming roller in the forming operation is stored; the shape of the mandrel near the point of the forming roller contacting with the work is estimated based on the motion of the forming roller from a time point before one rotation of the mandrel; and according to the estimation, the rotational speed of a motor for rotating the mandrel is controlled.

There is provided the metal spinning apparatus, further including: a jig shaped to merge into the front surface of the mandrel and capable of clamping the work fixedly between the mandrel and the jig; and the forming roller is fed at first in the direction of the axis of rotation of the mandrel while being forced onto the jig, so that the forming operation of the work is smoothly started.

Advantages of the Invention

The following effects are obtained by the metal spinning method and apparatus of the invention.

(1) A product having a non-circular cross section normal to an axis of rotation, such as a polygonal or elliptic product can be formed by spinning it. The forming roller moves back and forth in response to the feedback signals from the force sensor so that no excessive force is applied to the forming roller.

(2) The rotational speed of the mandrel can be raised in the section of a small fluctuation of the radius of the mandrel, while the part of the corner of a larger radial fluctuation can be precisely formed. The forming operation can be performed at a proper speed to reduce the whole forming time.

(3) The work can be smoothly formed while using the control of the pushing force of the forming roller from the beginning.

BEST MODE FOR CARRYING OUT THE INVENTION

The best mode for carrying out the invention is described in the following in connection with its embodiments with reference to the accompanying drawings.

EMBODIMENT 1

In the following, FIG. 1 is a schematic diagram of an embodiment of an apparatus for performing a metal spinning method of the invention.

The invention is provided with a forming roller 5 and actuators for driving the forming roller 5 to move longitudinally and transversely. A jig 2 is shaped to merge into the front surface of a mandrel 3, and a work 1 is fixedly clamped between the jig 2 and the mandrel so that it is rotated together with the mandrel 3 by a spindle motor 4. This spindle motor 4 is equipped with an angle sensor such as an encoder for detecting the angle of rotation.

The forming roller 5 is moved back and forth in the radial direction of the mandrel 3 by a linear motion table 6 driven by the (not-shown) actuator such as a ball screw or a hydraulic cylinder. On the other hand, the linear motion table 6 is moved back and forth in the direction of the axis of rotation of the mandrel 3 by a linear motion table 7. Each of these linear motion tables 6 and 7 is equipped with the (not-shown) displacement sensor such as an encoder for detecting the feed.

Moreover, the forming roller 5 is equipped with a force sensor 8, which can detect a forming force to be applied to the work 1. The work 1 is pushed onto the mandrel 3 by the forming roller 5 so that the work 1 is formed from an initial shape of a plate la finally into a shape 1*b* fitting the mandrel 3.

In case the cross section shape of the mandrel 3 normal to the axis of rotation is not a circle on the axis of rotation, the length of the radial direction fluctuates with the angle of rotation. In the radial direction, therefore, the pushing force of the forming roller 5 on the work 1 is controlled to cause the forming roller 5 to follow the fluctuation of the mandrel 3 in the radial direction.

FIG. 2 is a diagram showing relations among the forces to act on the forming roller 5. A force F to act on the forming roller 5 is decomposed into a force Fn in the normal direction and a force Ft in the tangential direction with respect to the side surface of the mandrel 3. In the invention, a pushing force FY in the radial direction of the forming roller 5 is so controlled that the normal force Fn may be equal to a target pushing force Fnd on the work 1. Moreover, the forming roller 5 is so positionally controlled that a displacement X of the forming roller 5 in the axial direction of the mandrel 3 may follow a target position Xd.

FIG. 3 is a diagram showing a summary of controls in the forming operation. The forming force F to act on the forming roller 5 is detected by the force sensor 8, and the normal component Fn on the side surface of the mandrel 3 is determined by a force-coordinate transformation. A deviation between the measured value Fn of the normal component and the target value Fnd of the pushing force of the forming roller 5 is extracted to calculate a driving force Tf of the linear motion table 6 on the basis of the force control law.

From displacement sensor signals of the linear motion table 7, on the other hand, the actually measured position X of the forming roller 5 in the direction of the axis of rotation of the mandrel 3 is determined. The deviation between the target position Xd and the measured position X of the forming roller 5 is extracted to calculate a driving force Tp for the position control of the linear motion table 7.

Thus, the forming roller 5 pushes, while moving in the direction of the axis of rotation of the mandrel 3 in accordance with the target position command Xd, the work 1 onto the mandrel 3 with the proper target pushing force Fnd, so that the forming roller 5 can form the work 1 following the mandrel 3.

Here in the method and apparatus of the invention, the forming roller 5 moves forward or backward in response to the radial fluctuations of the cross section shape of the mandrel 3, so that the upper limit of the rotational speed of the mandrel 3 is determined by the speed of response of the forming roller 5 to limit the forming rate.

Depending on the cross section shape of the mandrel 3, however, the radial fluctuations may be partially large and small. The whole forming rate can be improved by making the rotational speed of the mandrel 3 accordingly variable.

A cross section shape 9 normal to the axis of rotation is considered, for example, in the mandrel 3 of FIG. 4, there are a section 10, in which the feed of the forming roller 5 in the radial direction hardly changes, and a section 11, in which the same largely changes. Therefore, the forming time can be reduced as a whole, by raising the rotational speed of the mandrel 3 for the former section but by lowering the rotational speed of the mandrel 3 for the latter section so that the responding speed of the forming roller 5 may catch up.

Generally in the metal spinning operation, the feed of the forming roller 5 in the axial direction per rotation of the mandrel 3 is very small. This makes it possible to assume that the sectional shape 9, in which the forming roller 5 contacts with the work 1, and a sectional shape 9' before one rotation of the mandrel 3 are substantially identical.

Therefore, the motion of the forming roller 5 in the forming operation is measured by using an angle sensor of the spindle motor 4 and the displacement sensor of the linear motion table, and is stored in the format of displacement/velocity/acceleration of the forming roller 5 with respect to the angle of rotation of the mandrel 3.

Based on the motion (e.g., velocity/acceleration) of the forming roller 5 from a time point before one rotation of the mandrel 3, the shape of the mandrel 3 near the point of the forming roller 5 contacting with the work 1 is estimated, and according to the estimation, the rotational speed of the spindle motor 4 for rotating the mandrel 3 and the work 1 is controlled, so that the forming operation can be always performed at a proper speed.

What is used in these method and apparatus is only the motion data of the forming roller 5 of about one rotation of the mandrel 3, so that the necessary memory capacity is far less than the three-dimensional shape data of the whole product. Moreover, the motion of the forming roller 5 is stored while performing the forming operation in real time, so that the measurement of the mandrel 3 is unnecessary before the forming operation.

Since the work 1 before formed has a plate shape, how to start the forming operation is important, in case the pushing force of the forming roller 5 is controlled in the radial direction. In case the mandrel 3 having the shape of FIG. 5 is used, the jig 2 has a shape continuing from the front surface of the mandrel 3, and the work 1 is clamped and fixed between the jig 2 and the mandrel 3. At first, the forming roller 5 is pushed onto the jig 2 by controlling the pushing force, and the forming roller 5 is fed in the direction of the axis of rotation of the mandrel 3, so that the forming operation of the work 1 can be smoothly started.

EXPERIMENTAL EXAMPLES

Experiments were made for verifying the spinning method and apparatus according to the invention, as described in the following. An experimental apparatus used in the experiments is shown in FIG. 6. The experimental apparatus had basically the same constitution as that shown in Embodiment 1, and a forming roller 20 was enabled to move in directions of an X axis and a Y axis by individual motors 21 and 22. The conditions for setting the angle or the like of the forming roller 20 with respect to the mandrel 23 are described in the following.

For these linear feeds on the X axis and the Y axis, the ball screws were individually driven by the servo motors 21 and 22. The mandrel 23 (on θ-axis) was rotated by a servo motor 24 with a reduction gear. The θ-axis was slanted by 60 degrees with respect to the X axis.

The forming roller 20 had a diameter of 70 mm and a roundness of edge of 9.5 mm. A force sensor 25 was interposed between the forming roller 20 and the Y axis.

Two kinds of shapes of non-axisymmetric mandrels 26 and 28 were prepared. The shape of the mandrel 26 is shown in FIG. 7. The side surface of a conical mandrel was cut at four parts into flat planes. The section normal to the axis of mandrel rotation had a non-axisymmetric shape composed of circular arcs and straight lines. A blank 29 was a round disc of aluminum (Al050-O) having a diameter of 120 mm and a thickness of 0.78 mm.

The forming roller 20 had a feed rate Vx of 0.0177 mm, and the mandrel had an angular velocity of 7.5 rpm. The roller feed for one rotation of the mandrel was ΔX=0.141 mm. The forming method was the shear spinning method (in which the forming roller 20 was fed by one path along the mandrel so that the work 29 might be sheared). The forming roller 20 was controlled by the control law, as expressed by Formula 1:

[Formula 1]

$$f = \begin{bmatrix} f_x \\ f_y \end{bmatrix} = f_P + f_F$$

$$f_P = MJ^{-1}\begin{bmatrix} k_{vX}(V_{Xd} - V_X) + k_{pX}(V_{Xd}t - X) \\ 0 \end{bmatrix}$$

$$f_F = J^T\begin{bmatrix} 0 \\ cF_{nd} + k_{pF}(F_{nd} - F_n) + k_{iF}\int(F_{nd} - F_n)dt \end{bmatrix}$$

wherein: fx and fy designate actuator thrusts; Vx designates the feed rate of the forming roller 20; Vxd designates target value of the feed rate of the forming roller 20; Fn designates the pushing force of the forming roller 20; Fnd designates the target value of the pushing force of the forming roller 20; M designates the mass matrix of the actuators; J designates a transformation matrix between the actuator coordinate and the XY coordinate; c designates a positive constant; and kvX, kpX, kpF and kiF designate feedback gains.

The pushing force Fn of the forming roller 20 was set to 400 to 450 N. Here, the direction of Fn was fixed in the normal direction (i.e., 45 degrees relative to the mandrel axis) while the conical part was being formed. The forming roller displacements in the X direction parallel to and in the Y direction normal to the mandrel axis were shown in FIG. 8. In the X direction, little change occurred irrespective of the undulations of the surface of the mandrel so that the forming roller feed was realized at a constant value.

In the Y direction, on the other hand, the forming roller 20 was moved back and forth following the mandrel. The distance to the center position of the forming roller with respect to the mandrel axis is shown in FIG. 9. It is seen that the forming roller 20 was moved along the sectional shape of the mandrel.

The forming force, which was applied to the work 29 by the forming roller 20 for Fn=400 N, is shown in FIG. 10. Fn designates the normal force component against the surface of the mandrel; Ft designates the parallel component along the side surface of the mandrel; and FZ designates the tangential component to the mandrel rotation. The components Ft and Fz changed rather highly when the forming roller passed on the planar parts of the mandrel surface. This is because the forming roller and the mandrel surfaces obliquely contacted with each other at the planar pars, and because the contact angle changed. The pushing force Fn of the forming roller was also found to change a little but was held at about 400 N by the force control.

FIG. 11 presents the photographs of the mandrel 26 (located on the lefthand) and the completed product (located on the righthand). The planar part machined from the conical shape was also correctly formed to match the mandrel. The flange was also left as substantially flat. A laser displacement sensor was used to compare the surface shape of the mandrel of the planar parts and the profile of the product, and the result is presented in FIG. 12. The springback (i.e., the return by the elasticity after formed) was relatively small, and the product tightly fitted the mandrel.

The product had a thickness of 0.55 to 0.56 mm at its conical part and a thickness of 0.44 to 0.46 mm at its planar part. In the shear spinning case, the product had a thickness t=to sin α, when the inclination of the side surface to the mandrel axis was α, and when the original blank had a thickness to. As α=45 degrees at the conical part and α=35 degrees at the planar part, the thicknesses were calculated to 0.55 mm and 0.45 mm, respectively, which well coincided with the actual thicknesses.

The shape of another mandrel 28 is shown in FIG. 13. In this shape, the cone having a half angle of 30 degrees was slanted by 10 degrees, and was cut at its top and bottom. In this shape, the mandrel axis was eccentric, and the cross section normal to the axis was elliptic. The angle of the side surface to the mandrel axis was 40 degrees at the maximum and 20 degrees at the minimum.

By using this mandrel 28, the shear spinning operations were performed by changing the forming conditions such as the pushing force Fn and the feed of the forming roller 20, and the forming propriety was examined (FIG. 14). The rotating speed of the mandrel was 15 rpm for all cases. In FIG. 14, symbols ○ indicate that the product was formed successfully. At symbols X, fractures occurred (FIG. 15) at the wall faces of 20 degrees. At symbols Δ, wrinkles occurred at the flanges on the side of 40 degrees.

By increasing the pushing force of the forming roller 20, the fractures and the wrinkles could be prevented even at the same mandrel speed and with the same roller feed. FIG. 16 shows the photographs of the completed product and the mandrel 28.

The laser displacement sensor was used to compare the profiles of the product and the mandrel at the 20 deg and 40 deg longitudinal sections (FIG. 17). The forming parameters were the pushing force: 500 N, and the roller feed: 0.1 mm/rev. The formed product generally matched the mandrel overall, although the product was slightly displaced from the mandrel near the top of the 20 deg wall, and some springback was observed near the bottom of the 40 deg wall, but the product substantially matched the mandrel overall.

The product had a wall thickness of 0.50 to 0.52 mm at the 40 deg section. The thickness calculated by t=to sin α was 0.50 mm, which coincided well with the actual values. On the other hand, the thickness of the 20 deg section was 0.30 to 0.35 mm near the top and 0.20 to 0.22 mm near the flange.

A two-pass spinning was also tried as another method for preventing the wall fractures. At first, a shear spinning of a half angle of 45 degrees was performed midway with the material not contacting with the mandrel so that an intermediate product having a frusto-conical shape slightly larger than the mandrel was prepared. Next, the forming roller 20 was used to push the material onto the mandrel by the force to contact to finish the product (FIG. 18).

The mandrel speed and the roller feed were 240 rpm/0.05 mm for the first pass and 30 rpm and 0.2 mm for the second pass. The pushing force in the second pass was Fn=400 N, but the wall fracture did not occur as it did in the one-pass forming.

The wall thickness of the product at the 20 deg side was 0.47 to 0.50 mm near the top and 0.32 to 0.35 mm near the bottom. The thickness at the 40 deg side was 0.52 to 0.55 mm near the top and 0.50 to 0.52 near the bottom. The experimental example of Embodiment 1 has been described hereinbefore.

(Reduction of Forming Time)

One of the most important issue for the spinning method and apparatus according to the invention to form the non-axisymmetric shape practically is to reduce the forming time period. The forming time is expressed by (the height of product)÷(the roller feed per one rotation of the mandrel)÷(the mandrel speed per unit time). In the non-axisymmetric spinning, the mandrel speed has to be considerably lower than that of the axi-symmetric case, and this results in a long forming time.

In the non-axisymmetric forming, the forming roller 20 follows the sectional shape of the mandrel so that it repeats forward and backward movements as the mandrel rotates. If the mandrel speed becomes excessively high, the motion of the forming roller 20 cannot follow the fluctuations of the mandrel section so that the responses by the force control become vibratory to undulate the surface of the product or so that the pushing force onto the work 29 becomes short to allow the product to deviate from the mandrel. In the case of the experimental apparatus thus far described, those phenomena are found when the mandrel 26 exceeds about 15 rpm and when the mandrel 28 exceeds about 30 rpm.

Both the mandrel 26 and the mandrel 28 have a circular section or a circularly elliptic section near the top. In the forming operations using those mandrels, therefore, immediately after the start, the motions of the forming roller 20 following the sectional shape of the mandrels have small amplitudes so that the rpm and the torque of the motor for driving the forming roller 20 are found to have sufficient margins. When such parts are to be formed, therefore, it seems possible to raise the mandrel speed higher.

In the forming operations of the parts near the bottoms of the mandrels 26 and 28, on the other hand, the fluctuations or eccentricities of the mandrel sections become so larger that the forming roller 20 moves in the large amplitude. At the time of forming these parts, the forming roller 20 cannot follow the mandrel shapes thereby to raise problems. For these parts, it is necessary to suppress the mandrel speed sufficiently low.

In the shear spinning operation using the force control of the forming roller 20, the forming characteristics are substantially determined by the pushing force and the feed of the forming roller 20. Therefore, the pushing force Fn and the feed ΔX are held constant, only the speed of ω=dθ/dt of the mandrel 28 is controlled according to the positional amplitude of the forming roller 20.

The feed rate VX of the forming roller 20 is expressed by the following Formula 2:

$$V_X=\Delta X\omega/2x \qquad \text{[Formula 2]}$$

The mandrel speed is suppressed at the part, in which the forming roller 20 moves largely in the Y direction, but is raised at the part, in which motion of the forming roller 20 is so small as to have margins for the speed, so that the forming time is reduced as a whole.

The specific control rule for the mandrel speed is conceived to satisfy the following relation of Formula 3:

$$V_Y^2+K\omega^2=V \qquad \text{[Formula 3]}$$

Here: ω designates the speed of the angle of rotation of the mandrel; VY designate the forming roller velocity in the direction normal to the mandrel axis; K and Y designate positive constants. The above formula implies that the tangential velocity is constant in the non-dimensional actuator space. Here, the forming roller 20 contacts with the rotating mandrel so that its displacement is expressed by Y(θ) as a function of θ. Hence, the following Formula 4 holds:

$$V_Y=\frac{dY}{d\theta}\omega \qquad \text{[Formula 4]}$$

The term of dY/dθ is determined by the cross-sectional shape of the mandrel, and indicates the change of the forming roller position Y due to the rotation of the mandrel. The following Formula 5 is obtained by substituting Formula 4 into Formula 3:

$$\left\{\left(\frac{dY}{d\theta}\right)^2+K\right\}\omega^2=V \qquad \text{[Formula 5]}$$

The mandrel speed may be the following Formula 6:

$$\omega=\sqrt{V\Big/\left\{\left(\frac{dY}{d\theta}\right)^2+K\right\}} \qquad \text{[Formula 6]}$$

As the fluctuation dY/dθ of the forming roller position becomes the larger, the mandrel speed ω becomes the lower. When the section of the mandrel is circular and when the forming roller position Y does not fluctuate (dY/dθ=0), the mandrel speed takes the maximum. Since K is a coefficient for normalization, it can be determined on the basis of VY and ω when the individual motors are at the rated speeds.

Moreover, the maximum mandrel speed can be ωMAX by taking V, as expressed by the following Formula 7:

$$V=K\omega_{MAX}^2 \qquad \text{[Formula 7]}$$

Let it be considered what data is used as dY/dθ. Formula 4 is expressed as in the following Formula 8:

$$\frac{dY}{d\theta} = \frac{V_Y}{\omega} \quad \text{[Formula 8]}$$

By actually measuring VY and ω in the forming operation, therefore, the dY/dω can be known in real time. Generally, the feed of the forming roller 20 in the direction of the mandrel rotation is very small. By recording the dY/dω for one rotation of the mandrel, therefore, the shape data on the cross section shape of the mandrel can be substantially obtained.

In order that the mandrel speed might change relatively gently, the average value $|(dY/d\theta)^2|$ of one rotation (from a time point before one rotation of the mandrel) of $(dY/d\theta)^2$ was determined and was substituted into the Formula 6 so that the mandrel speed was determined.

In this method, only the data $(dY/d\theta)^2$ of one rotation of the mandrel is used, so that the necessary memory capacity is far smaller than that for the three-dimensional shape data of the whole mandrel. Moreover, the data can be acquired while forming in real time, and the measurement is unnecessary before forming.

The forming experiments by the mandrel 28 were done by using the control rule of the mandrel speed. The feed rate Vx of the forming roller 20 changes in proportion to the mandrel speed. The pushing force of the forming roller 20 was 480 N, and the roller feed was 0.1 mm/rev.

FIG. 19 shows the speeds of the forming roller 20 at the time when the positions of (a) 5 mm and (b) 20 mm from the top were formed. The mandrel speeds were automatically controlled to 64.3 rpm for (a), and 16.0 rpm for (b). Although the positional amplitude of the forming roller 20 was larger for (b), the peak values of the forming roller speed for the two cases were suppressed to about ±0.01 m/sec by the change in the mandrel speed. It has also been confirmed that the quality of the formed product such as precision or wall thickness was not different from that of the case, in which the mandrel was rotated at a constant speed.

FIG. 20 shows the change in the mandrel speed from the start to the end of the forming operation. The total forming time was 569.6 secs. When the mandrel was rotated at the minimum speed (13.2 rpm) from the beginning to the last, the forming time was 1,100.6 secs. Thus, the forming time was reduced to about one half.

By the experiments thus far described, it has been confirmed that the product of the non-axisymmetric shape can be formed in the spinning of the metal sheet by causing the forming roller 20 to follow the mandrel shape, using the hybrid position/force control. The method for reducing the forming time by controlling the mandrel speed has been proposed, and its effectiveness can be verified.

Although the best mode for carrying out the metal spinning method and apparatus according to the invention has been described in connection its embodiments, the invention should not be limited to those embodiments. It goes without saying that the invention can have various modes of embodiment within the range of the technical items of claims.

INDUSTRIAL APPLICABILITY

The metal spinning method and apparatus according to the invention can spin a product having a non-circular cross section shape such as a polygonal/elliptic one, so that they can be widely applied to manufactures of parts or products such as tank bottom plates, engine parts, decorative craft-arts or illuminators.

DESCRIPTION OF REFERENCE NUMERALS AND SIGNS

Figure 1:
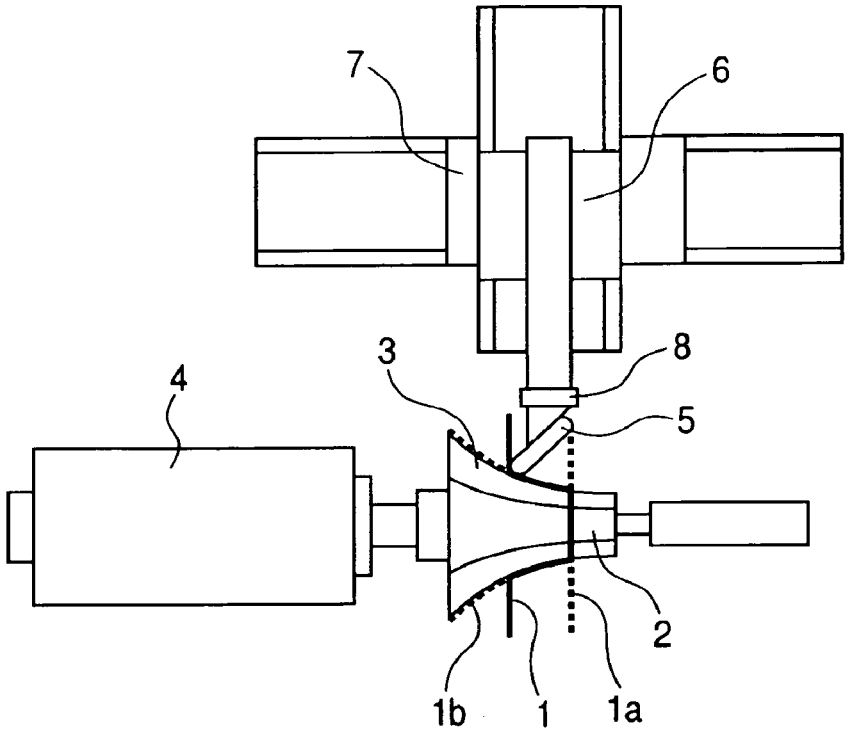
[FIG. 1] A schematic diagram of an embodiment of an apparatus for performing a spinning method of the invention
Figure 2:
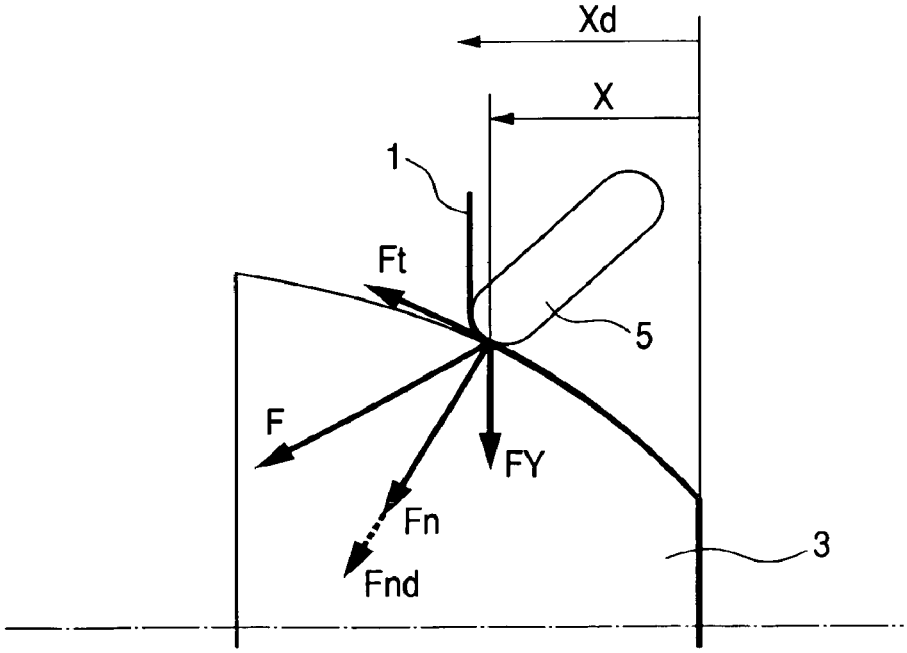
[FIG. 2] A diagram showing forces to act on a forming roller
Figure 3:
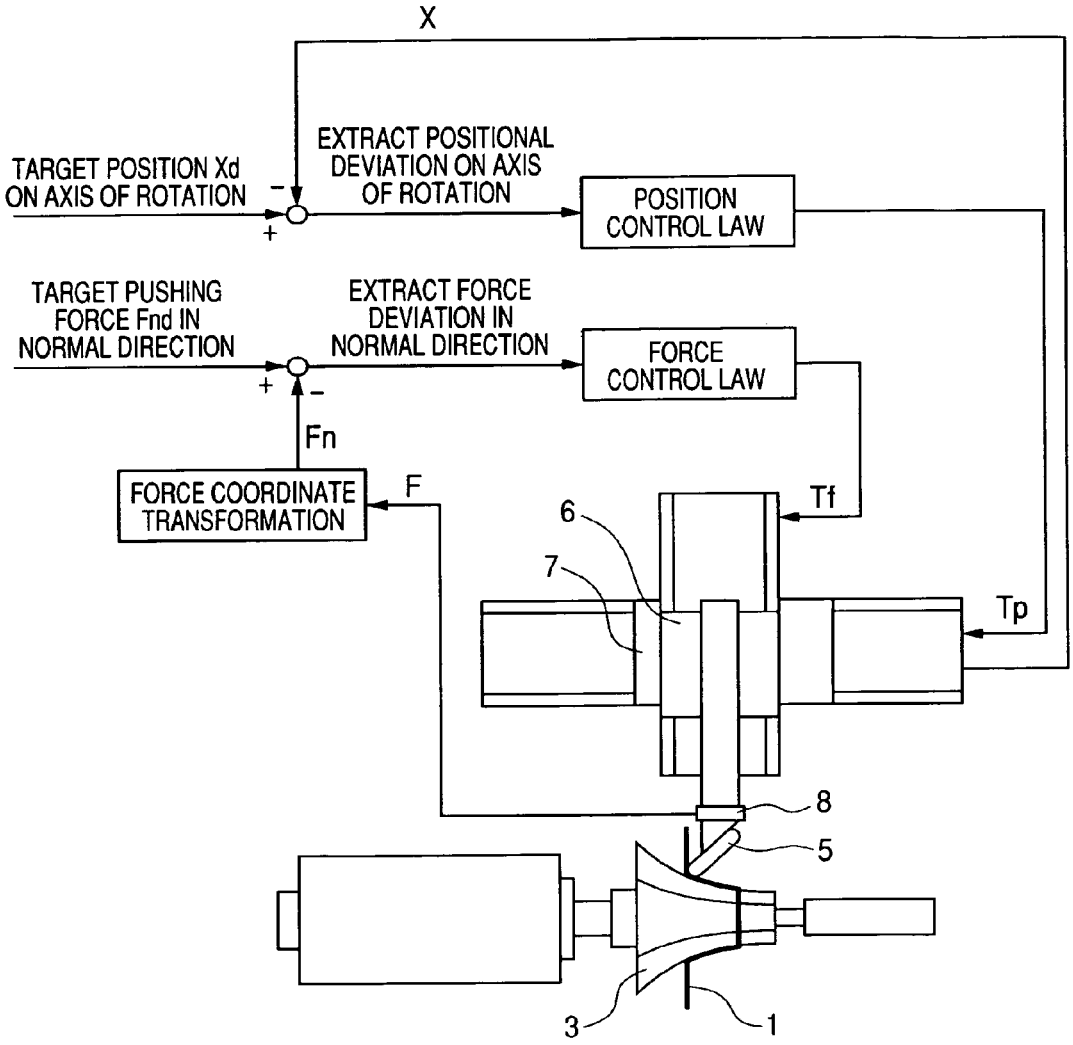
[FIG. 3] A diagram showing a summary of controls in forming
Figure 4:
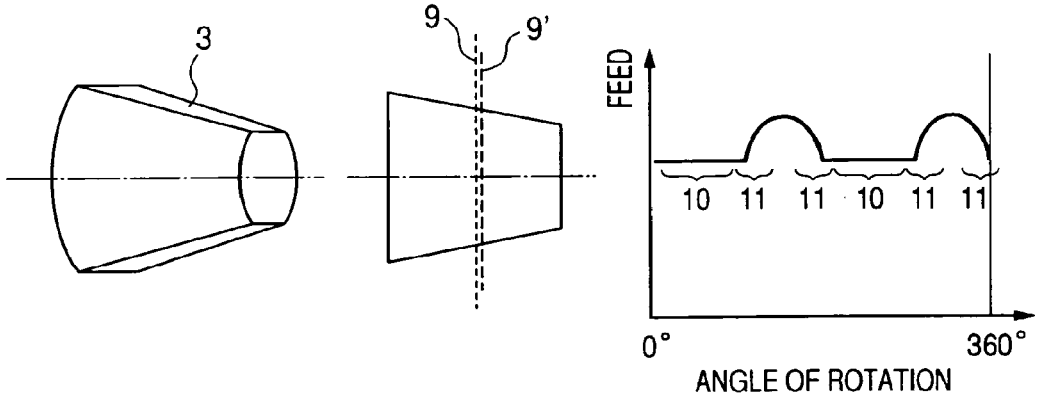
[FIG. 4] A diagram showing the sectional shape of a product and a feed in the radial direction
Figure 5:
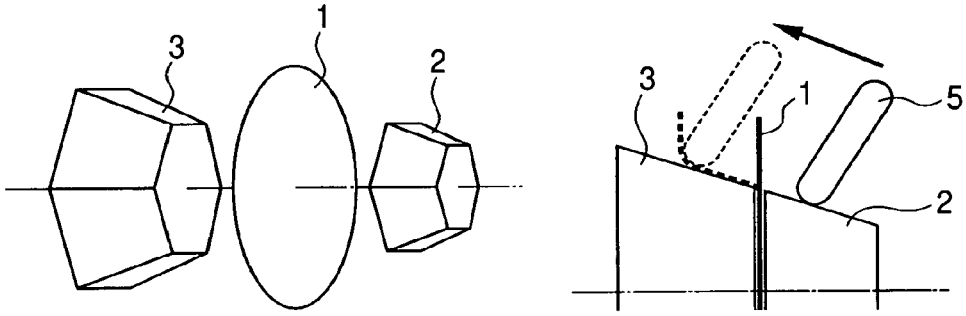
[FIG. 5] A diagram for explaining the functions of a jig at a forming starting time
Figure 6:
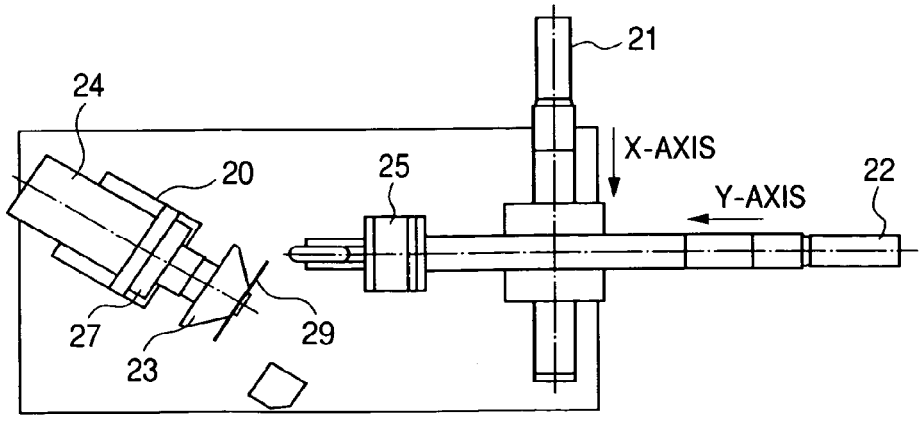
[FIG. 6] A diagram showing an experimental apparatus for verifying the spinning method and apparatus according to the invention
Figure 7:
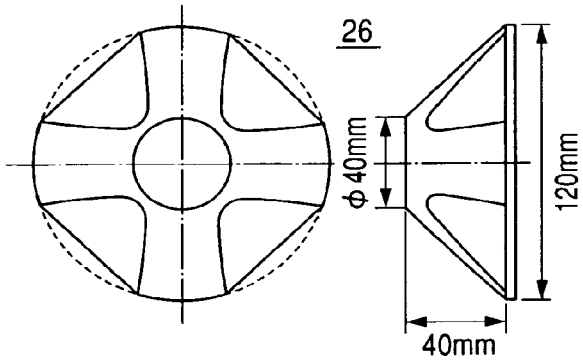
[FIG. 7] A diagram showing one mandrel used in the experiments
Figure 8:
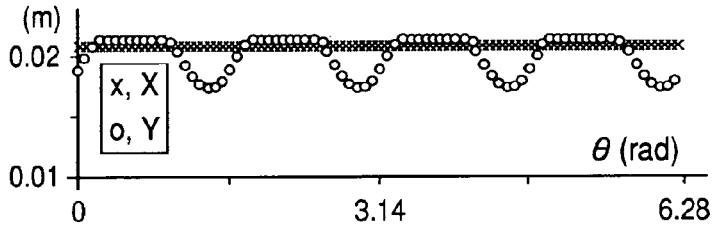
[FIG. 8] A diagram showing an experimentally obtained graph (plotting the forming roller displacements in the X direction parallel to and in the Y direction normal to the axis of rotation)
Figure 9:
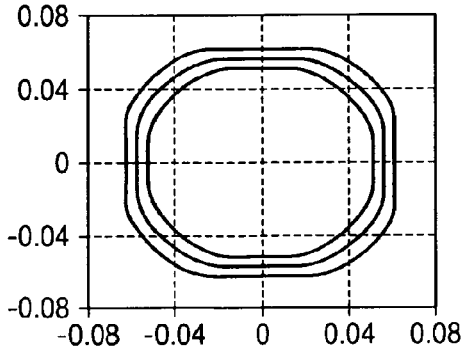
[FIG. 9] A diagram showing an experimentally obtained graph (in which the distance to the center position of the forming roller with respect to the mandrel axis is plotted)
Figure 10:
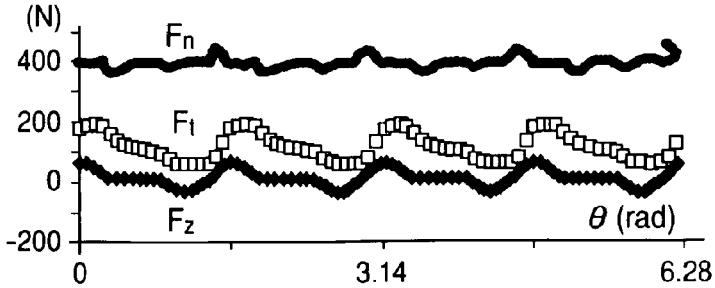
[FIG. 10] A diagram showing a forming force to be applied to the material by the forming roller
Figure 11:
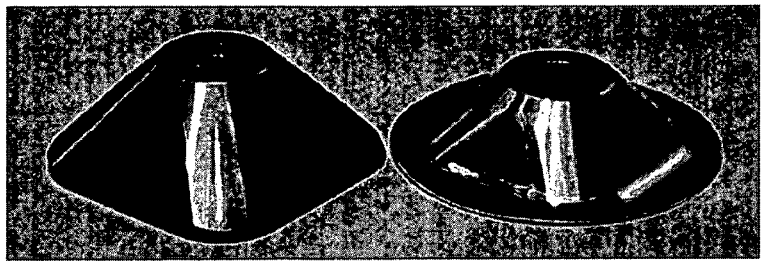
[FIG. 11] A diagram presenting the photographs of the mandrel 26 and the formed product
Figure 12:
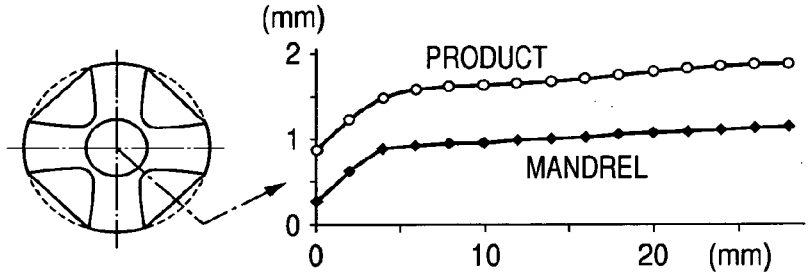
[FIG. 12] A diagram presenting the result of comparing the side surface shape of the mandrel of the planar parts and the outer shape of the product, by using a laser displacement sensor
Figure 13:
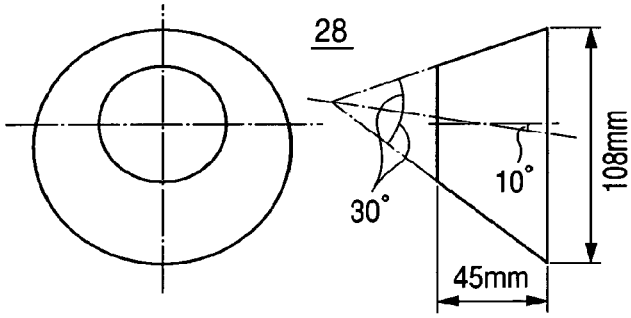
[FIG. 13] A diagram showing the shape of another mandrel used in the experiments
Figure 14:
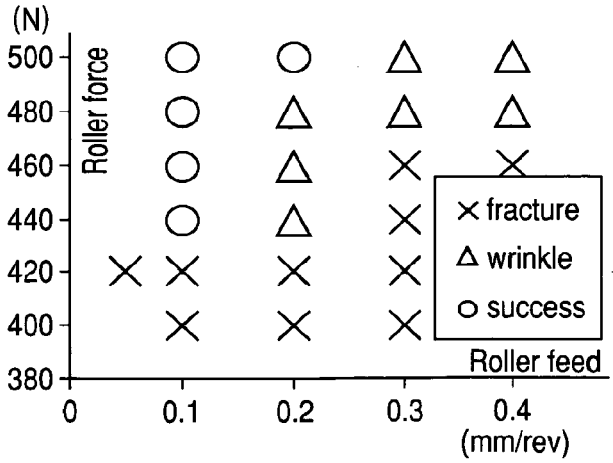
[FIG. 14] A diagram presenting the results, in which the forming operations are performed by changing the pushing force Fn and the roller feed and in which the forming propriety is examined
Figure 15:
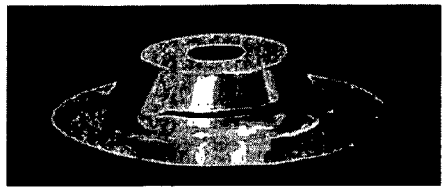
[FIG. 15] A diagram presenting a photograph of a product
Figure 16:
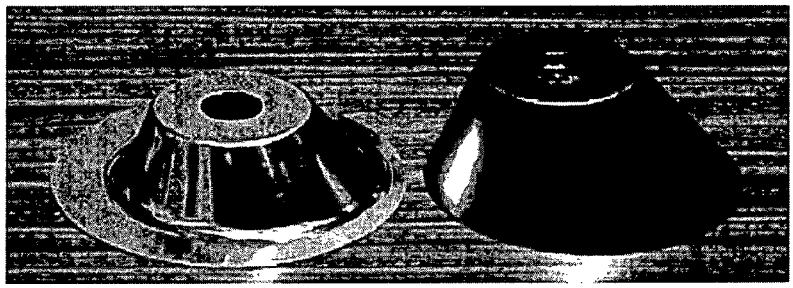
[FIG. 16] A diagram showing the photographs of the well-shaped product and the mandrel 28
Figure 17:
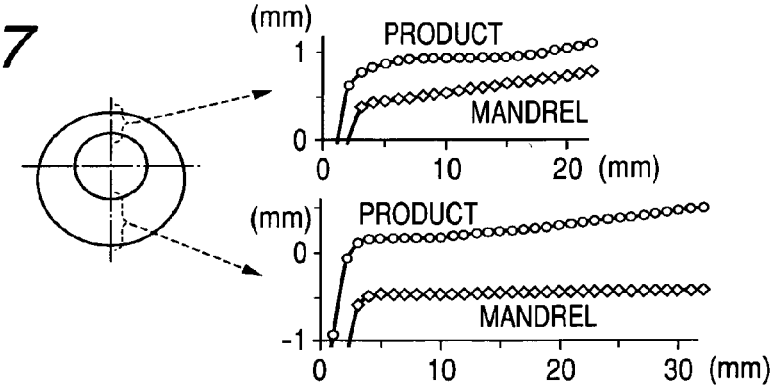
[FIG. 17] A diagram presenting the results, in which the laser displacement sensor is used to compare the side surface shapes of 20 degrees and 40 degrees of the mandrel of the planar part and the outer shape of the product
Figure 18:
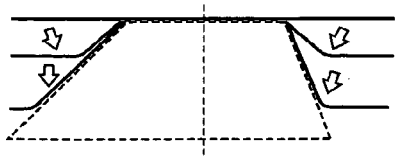
[FIG. 18] A diagram showing a two-pass forming operation
Figure 19:
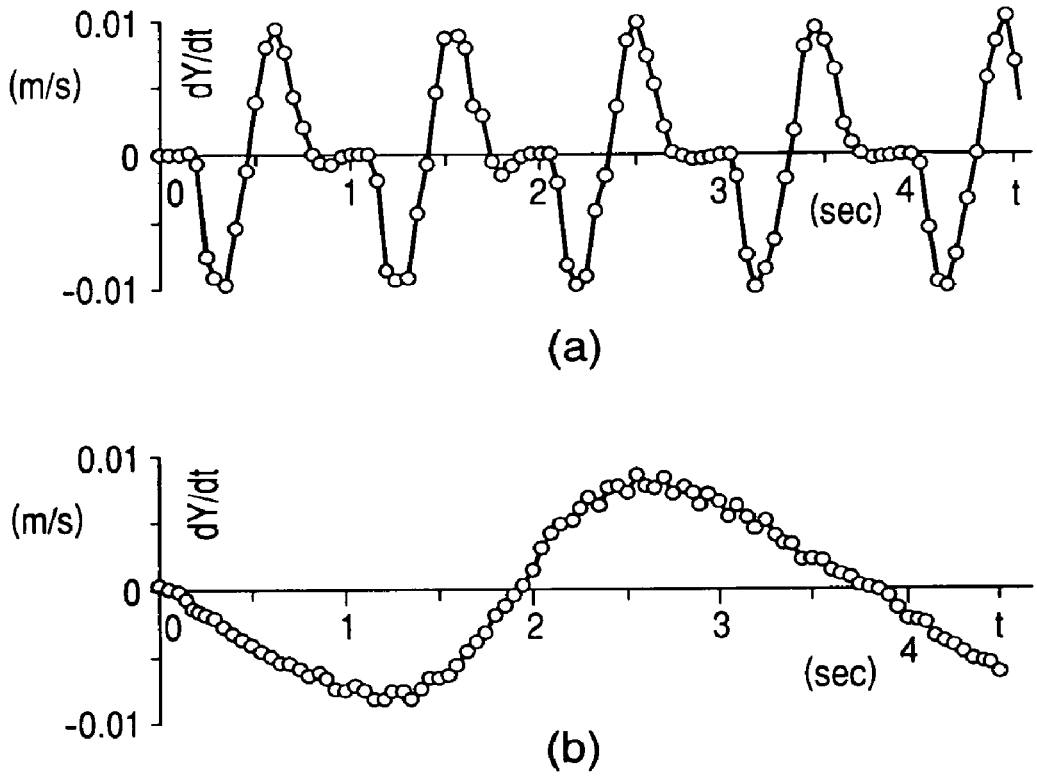
[FIG. 19] A diagram showing the speeds of the forming roller at the time when the positions of (a) 5 mm and (b) 20 mm from the top are processed
Figure 20:
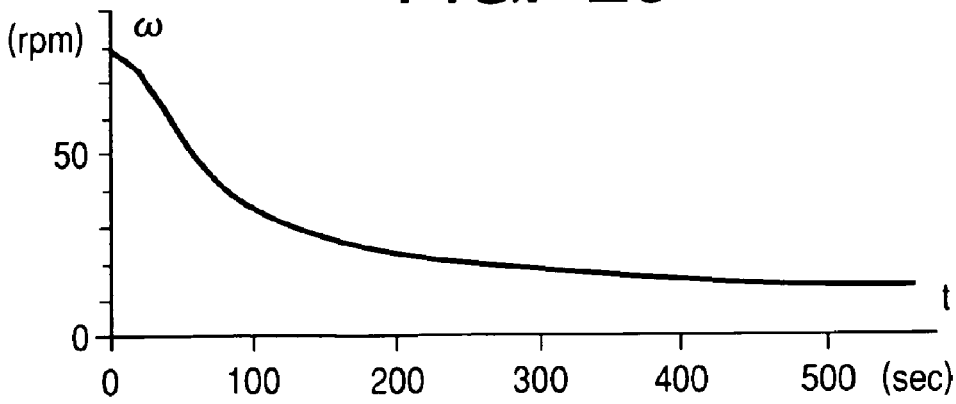
[FIG. 20] A diagram showing the change in the mandrel speed from the start to the end of the forming operation

1, 9 WORK
1*a* INITIAL SHAPE OF WORK
1*b* FINAL SHAPE OF WORK
2 JIG
3, 23, 26, 28 MANDREL
4, 21, 22, 24 MOTOR
5, 20 FORMING ROLLER

6, 7 LINEAR MOTION TABLE
8 FORCE SENSOR
9, 9' CROSS SECTION OF MANDREL
10 SECTION OF NO CHANGE IN RADIAL FEED
11 SECTION OF LARGE CHANGE IN RADIAL FEED
25 6-AXIS FORCE SENSOR
27 REDUCTION GEAR

The invention claimed is:

1. A metal spinning method for forming a work of a metal sheet by pushing the work onto a rotating mandrel using a forming roller, the metal spinning method comprising the steps of:

driving actuators of the forming roller with feedback signals from a force sensor fitted to the forming roller, to control a pushing force of the forming roller; and forming the work following the cross section shape of the mandrel, so that the product having a non-circular cross section normal to the axis of rotation can be formed, wherein the shape of the mandrel near the point of the forming roller contacting with the work is estimated based on the motion of the forming roller from a time point before one rotation of the mandrel; and according to the estimation, the rotational speed of a motor for rotating the mandrel is controlled for the forming operation.

2. The metal spinning method as set forth in claim 1, wherein the motion of the forming roller in the forming operation is stored.

3. The metal spinning method as set forth in claim 1, wherein a jig shaped to merge into the front surface of the mandrel is used to clamp the work fixedly between the mandrel and the jig; and the forming roller is fed at first in the direction of the axis of rotation of the mandrel while being pushed onto the jig, so that the forming operation of the work is smoothly started.

4. A metal spinning apparatus comprising:

a forming roller having a force sensor fixed thereto, and actuators for driving the forming roller, wherein the actuators drive the forming roller to spin a work of a metal sheet by pushing the work onto a rotating mandrel;

the actuators control a pushing force of the forming roller with feedback signals from the force sensor; and the forming roller forms the work following the cross section shape of the mandrel, so that the product having a non-circular cross section normal to the axis of rotation of the mandrel can also be formed, wherein the shape of the mandrel near the point of the forming roller contacting with the work is estimated based on the motion of the forming roller from a time point before one rotation of the mandrel; and according to the estimation, the rotational speed of a motor for rotating the mandrel is controlled.

5. The metal spinning apparatus as set forth in claim 4, wherein the motion of the forming roller in the forming operation is stored.

6. The metal spinning apparatus as set forth in claim 4, further comprising:

a jig shaped to merge into the front surface of the mandrel and capable of clamping the work fixedly between the mandrel and the jig; and the forming roller is fed at first in the direction of the axis of rotation of the mandrel while being forced onto the jig, so that the forming operation of the work is smoothly started.

* * * * *